US005221328A

United States Patent [19]

Bishop et al.

[11] Patent Number: 5,221,328

[45] Date of Patent: Jun. 22, 1993

[54] METHOD OF CONTROLLING ORTHOPHOSPHITE ION CONCENTRATION IN HYPHOPHOSPHITE-BASED ELECTROLESS PLATING BATHS

[75] Inventors: Craig V. Bishop, Lakewood; Gary W. Loar; Marlinda J. Thomay, both of Parma, all of Ohio

[73] Assignee: McGean-Rohco, Inc., Cleveland, Ohio

[21] Appl. No.: 800,596

[22] Filed: Nov. 27, 1991

[51] Int. Cl.[5] ..... C23C 18/36; C23C 18/38

[52] U.S. Cl. ..... 106/1.23; 106/1.26; 106/1.27

[58] Field of Search ..... 106/1.23–1.27

[56] References Cited

U.S. PATENT DOCUMENTS

| | | | |
|---|---|---|---|
| 2,658,839 | 11/1953 | Talmey et al. | 117/102 |
| 2,762,723 | 9/1956 | Talmey et al. | 117/130 |
| 3,310,430 | 3/1967 | Schneble, Jr. et al. | 117/130 |
| 3,615,732 | 10/1971 | Shipley, Jr. et al. | 106/1.23 |
| 3,615,733 | 10/1971 | Shipley, Jr. et al. | 106/1.23 |
| 3,650,777 | 3/1972 | Schnerle, Jr. et al. | 106/1.23 |
| 4,717,421 | 1/1988 | Frisby | 106/1.11 |

OTHER PUBLICATIONS

Derwent Abstract 86-192773/30, Jun. 1986.

The Systems $Y_2O_3$—$P_2O_5$ and $Gd_2O_3$—$P_2O_5$, J. Electrochem Soc.: Solid-State and Technology, Jul. 1980, pp. 1550–1554.

*Primary Examiner*—Mark L. Bell

*Assistant Examiner*—Margaret Einsmann

*Attorney, Agent, or Firm*—Renner, Otto, Boisselle & Sklar

[57] ABSTRACT

This invention relates to a method of controlling orthophosphite ion concentration in a hypophosphite-based electroless metal plating bath, comprising the steps of contacting the plating bath with a yttrium or a lanthanide series metal salt, and removing orthophosphite ions from the bath. The methods of the present invention provide effective means for controlling phosphite ion concentration in electroless metal plating baths and especially electroless nickel plating baths. The methods of the present invention provide means for increasing pH and removing orthophosphite ions from the plating bath.

19 Claims, No Drawings

METHOD OF CONTROLLING ORTHOPHOSPHITE ION CONCENTRATION IN HYPHOPHOSPHITE-BASED ELECTROLESS PLATING BATHS

TECHNICAL FIELD OF THE INVENTION

This invention relates to methods of controlling orthophosphite ions in electroless plating baths.

INTRODUCTION TO THE INVENTION

Electroless plating has been described as a controlled autocatalytic chemical reduction process for depositing metals. The process involves continuous buildup of metal coating on a substrate by immersion of the substrate in a suitable plating bath. The plating bath generally consists of an electroless metal salt together with a reducing agent. Electroless metal-hypophosphite baths use hypophosphite ions as a reducing agent during which the hypophosphite ions are oxidized to orthophosphite ions. As the level of orthophosphite ions in the bath increases, the rate of deposition of metal decreases. Also, the reducing power of hypophosphite ions is decreased as the pH value of the bath decreases, e.g., becomes more acidic. Therefore, it is desirable to have a method for controlling orthophoshite ion concentration and pH in electroless plating baths.

U.S. Pat. No. 2,658,839 relates to a process of chemical nickel plating. The process involves maintaining substantially constant relative and optimal concentration and proportions of the reagents in the bath as well as holding the pH of the bath within desired narrow optimal limits.

U.S. Pat. No. 2,762,723 relates to processes of chemical nickel plating and baths thereof. The process uses addition of certain water-soluble additives of dipolar molecular character to stabilize nickel cation-hypophosphite anion baths. Additives of dipolar molecular form include sulfhydric compounds.

U.S. Pat. No. 3,310,430 relates to electroless copper plating Hydrogen free electroless copper is produced when the electroless copper solutions contain simple or complex compounds which comprise one or more of the elements vanadium, molybdenum, niobium, tungsten, ruthenium, arsenic, antimony, bismuth, hectinium, lanthanum, rare earths of both the lanthanum and actinium series, and mixtures of the foregoing.

U.S. Pat. Nos. 3,615,732 and 3,615,733 relate to electroless copper plating. These patents disclose the use of hydrogen inclusion retarding agents of the class disclosed in U.S. Pat. No. 3,310,430.

U.S. Pat. No. 3,650,777 relates to electroless copper plating. This patent discloses the use of stabilizing agents which are simple or complex compounds, comprising one or more of the elements, molybdenum, niobium, tungsten, ruthenium, rare earths of actinide, e.g., actinium, uranium and the like, rare earths of lanthanide series, e.g., lanthanum, neodymium, ytterbium and the like as well as mixtures of these compounds.

Relevant literature on solubility of yttrium and lanthanum phosphites and hypophosphites has been compiled by Malinina, A.T., et al., "Rare Earth Elements and Yttrium Hypophosphites", Trudy Tomskogo Gosudarstvennogo Univerfiteta, 237,115-26 (1973), (CA(80) (10):55397S); "Rare Earth Elements and Yttrium Hypophosphites," Trudy Tomskogo Gosudarstvennogo Univerfiteta, 192, 31-6 (1968), (CA(73) (14):72592Z).

SUMMARY OF THE INVENTION

This invention relates to a method of controlling orthophosphite ion concentration in an electroless metal plating bath, comprising the steps of contacting a hypophosphite based electroless metal plating bath with a yttrium metal salt or a lanthanide series metal salt, and removing orthophosphite ions from the bath.

The methods of the present invention provide effective means for controlling orthophosphite ion concentration in electroless plating baths, especially electroless nickel plating baths. The methods of the present invention provide means for increasing pH, and removing ortho-phosphite ions from the plating bath.

DETAILED DESCRIPTION OF THE INVENTION

Electroless nickel deposition proceeds, at elevated temperature, in accordance with the equation:

$$2H_2PO_2^- + 2H_2O + Ni^{+2} + Ni^{\circ}(s) + H_2(g) + 2H^+ 2H_2PO_3$$

From this equation it is apparent that the dihydrogen phosphorous acid (orthophosphite) concentration will continue to increase and the pH decrease as electroless nickel is deposited. The rate of electroless nickel deposition is affected by the di-hydrogen phosphorous acid concentration in accordance with the well known rate laws and the principles of chemical equilibrium summarized by LeChatelier "an alteration in any condition that determines the state of a system in equilibrium will cause the position of equilibrium to shift in a manner that tends to counteract the alteration". Thus, when an electroless nickel solution is new, and the di-hydrogen phosphorous acid concentration is low, the rate of deposition is greater than later when the di-hydrogen phosphorous acid concentration is higher, unless the pH is adjusted, temperature raised, and di-hydrogen hypophosphorous acid concentration increased.

Methods of the present invention involve batch as well as continuous electroless plating processes. The methods of the present invention act to decrease the level of orthophosphite ion in the electroless plating bath. This process acts to regenerate spent plating baths. Spent plating baths are plating baths which would be determined by an operator to be ineffective for plating and would be discarded. For plating baths directed to high corrosion resistant materials, the orthophosphite ion concentration in a "spent" bath would be about 30–40 grams per liter. For general plating operations, a spent bath would contain at least about 40–100 grams per liter of orthophosphite ion.

With this invention a yttrium or a lanthanide salt such as a carbonate or hypophosphite, is contacted with or added to an electroless nickel solution containing di-hydrogen phosphorous acid. The a yttrrium or a lanthanide salt of di-hydrogen phosphorous acid is then precipitated. When the salt anion is a carbonate, excess acid is also neutralized. When the salt anion is hypophosphite a simple exchange of orthophosphite for hypophosphite will occur. The following equations describe the two processes:

$$Y_2(CO_3)_3.3H_2O + 6H_2PO_{3-} + 6H^+ = 2Y(H_2PO_3)_3(s) + 3H_2O + 3CO_2(g)$$

$$Y(H_2PO_2)_3 + 3H_2PO_3^- = Y(H_2PO_3)_3(s) + 3H_2PO_2^-$$

Generally, in the batch procedures, the yttrium or lanthanide series metal salt is added to the plating bath in an amount sufficient to remove at least about one-half the orthophosphite ion concentration. Preferably the yttrium or lanthanide series metal salt is added in an amount sufficient to remove at least three-fourths of the orthophosphite ion concentration in the bath. The metal salt is generally added as a soluble metal salt, e.g., soluble in the electroless plating bath. The yttrium or lanthanide series metal phosphite salts precipitate and therefore remove phosphite ions from the bath. By removal of the orthophosphite ions, the bath is regenerated and the rate of plating is maintained or increased.

The methods of the present invention also are applicable to continuous processes. In the continuous processes the method of the invention acts to control and maintain the orthophosphite ion concentration at a specific level. The continuous process involves contacting the hypophosphite-based electroless metal plating bath with an amount of yttrium or lanthanide series metal salt to maintain the phosphite ion concentration at a specific level. In one embodiment, soluble yttrium a lanthanide series metal salts are added to the bath. These salts may be added alone or as part of a solution which can be delivered by a pump.

In another embodiment, the electroless metal bath is contacted with yttrium or lanthan series metal salt which is on a support medium. The salts may be placed on a filter or other support material by means known to those in the art. The bath may then be pumped through the supported salts. The salts and their supports may also be suspended in the bath to provide contact of the bath with yttrium or the lanthanide series metal salt.

The plating baths contain electroless metals which are capable of autocatalytic deposition and include nickel, copper or cobalt, preferably nickel. These metals are present as water-soluble salts, such as sulfates, carbonates, nitrates, and halides, including chlorides or fluorides.

As described above, the orthophosphite ion concentration is controlled by using yttrium or a lanthanide series metal salt. The lanthanide series metals include metals with atomic numbers from 57 to 70. Useful metals include yttrium, lanthanum, cerium, praseodymium, samarium, europium, neodymium, terbium, dysprosium, holmium, erbium, thulium or mixtures thereof, more preferably yttrium or lanthanum. It should also be evident that many rare earth elements or compounds can be added to an electroless nickel solution and subsequently oxidize to an ion capable of precipitating orthophosphite ions. The metals are generally delivered in a water-soluble form, such as halides, phosphates, carbonates, sulfates, sulfites, oxides, and organoacids, such as formates, acetates, 2-ethylhexanoates, tartrates, lactates and methane sulfonates. Double salts of yttrium and the lanthanide metals may also be used. Yttrium carbonate is particularly useful metal salt.

In one embodiment, the pH may be controlled by addition of yttrium carbonate to the electroless plating bath. Yttrium carbonate under acidic solution conditions forms carbon dioxide which increases the pH of the bath. The increase in pH increases the rate of deposition.

Other materials may be included in the metal plating baths which may be used in the present invention, such as brighteners, exaltants, stabilizers and the like. For instance, one or more of hydroxy acetic acid, sodium citrate, succinic acid, sodium acetate, sodium fluoride, lactic acid, propionic acid, ammonium chloride, sodium hydroxide and sodium pyrophosphate may be present in the bath. These materials and their uses are known to those in the art.

In practice the "life" of an electroless nickel process is described in terms of regenerations, where one regeneration is equivalent to the deposition of an initial concentration of nickel ion. Throughout the "life" of an electroless nickel solution, nickel ion, di-hydrogen hypophosphorous acid, and a neutralizing alkali (eg. ammonium hydroxide, sodium hydroxide, sodium carbonate) are added to replenish the deposited nickel, the reacted di-hydrogen hypophosphorous acid, and neutralize the excess acid formed by the deposition process. It is generally the case that acceptable deposits can be obtained from solutions which have been through six to ten regenerations. Typically, depending upon the care given to filtering the solution, preventing contamination from other sources, and the rate of solution "drag out" when the number of regenerations exceeds ten, the rate of the reaction becomes so slow as to be economically inefficient for production of finished parts. At this point, the solution is discarded and a fresh solution started.

The reason for the change in rate is the increase in di-hydrogen phosphorous acid concentration. As the number of regenerations increases so the di-hydrogen phosphorous acid concentration increases by a factor of twice the moles of total nickel deposited. Thus, without dragout, at the end of ten regenerations the concentration of di-hydrogen phosphorous acid would be twenty times the initial molar concentration of nickel ion, or 2.7 times the initial mass/volume concentration of nickel ion.

The following tables relate to electroless nickel and electroless cobalt baths which may be used in the methods of the present invention.

TABLE 1

ELECTROLESS NICKEL PLATING

Bath Compositions for Electroless Nickel Deposition Using Hypophosphite Reducing Agent

| | Acid Baths | | | | | Alkaline Baths | | |
|---|---|---|---|---|---|---|---|---|
| Bath Constituents, g/l | 1 | 2 | 3 | 4 | 5 | 6 | 7 | 8 |
| Nickel chloride, $NiCl_2.6H_2O$ | 30 | 30 | — | 21 | 26 | 30 | 20 | — |
| Nickel sulfate, $NiSO_4.6H_2O$ | — | — | 25 | — | — | — | — | 25 |
| Sodium hypophosphite, $NaH_2PO_2.H_2O$ | 10 | 10 | 23 | 24 | 24 | 10 | 20 | 25 |
| Hydroxyacetic acid, $HOCH_2COOH$ | 35 | — | — | — | — | — | — | — |
| Sodium citrate, $Na_3C_6H_5O_7.2H_2O$ | — | 12.6 | — | — | — | 84 | 10 | — |
| Sodium acetate, $NaC_2H_3O_2$ | — | 5 | 9 | — | — | — | — | — |
| Succinic acid, $C_4H_6O_4$ | — | — | — | 7 | — | — | — | — |

TABLE 1-continued

ELECTROLESS NICKEL PLATING
Bath Compositions for Electroless Nickel Deposition Using Hypophosphite Reducing Agent

| Bath Constituents, g/l | Acid Baths 1 | 2 | 3 | 4 | 5 | Alkaline Baths 6 | 7 | 8 |
|---|---|---|---|---|---|---|---|---|
| Sodium fluoride, NaF | — | — | — | 5 | — | — | — | — |
| Lactic acid, $C_3H_6O_3$ | — | — | — | — | 27 | — | — | — |
| Propionic acid, $C_3H_6O_2$ | — | — | — | — | 2.2 | — | — | — |
| Ammonium chloride, $NH_4Cl$ | — | — | — | — | — | 50 | 35 | — |
| Sodium pyrophosphate, $Na_4P_2O_7$ | — | — | — | — | — | — | — | 50 |
| Lead iron, $Pb^{2+}$ | — | — | 0.001 | — | 0.002 | — | — | — |
| Alkali for neutralizing | NaOH | NaOH | NaOH | NaOH | NaOH | $NH_4OH$ | $NH_4OH$ | $NH_4OH$ |
| Ph | 4–6 | 4–6 | 4–8 | 6 | 4.6 | 8–10 | 9–10 | 10–11 |
| Temperature, °C. | 90–100 | 90–100 | 85 | 90–100 | 90–100 | 85 | 85 | 70 |
| Approximate deposition rate, μm/hr | 15 | 7 | 13 | 15 | 20 | 6.5 | 17 | 15 |

TABLE 4

ELECTROLESS COBALT PLATING
Bath Compositions for Electroless Cobalt Deposition

| Bath Constituents, g/l | Bath 1 | 2 | 3 | 4 | 5 |
|---|---|---|---|---|---|
| Cobalt chloride, $CoCl_2.6H_2O$ | 30 | 30 | 7.5 | 27.1 | — |
| Cobalt sulfate, $CoSO_4.7H_2O$ | — | — | — | — | 24 |
| Sodium hypophosphite, $NaH_2PO_2.H_2O$ | 20 | 20 | 3.5 | 9 | 20 |
| Sodium citrate, $Na_3C_6H_5O_7.2H_2O$ | 84.5 | 29.6 | 27.4 | 90 | 70 |
| Ammonium chloride, $NH_4Cl$ | 50 | 50 | 12.5 | 45.3 | — |
| Ammonium sulfate, $(NH_4)_2SO_4$ | — | — | — | — | 40 |
| Sodium lauryl sulfate, $C_{12}H_{25}O_4SNa$ | — | — | 0.015 | — | 0.1 |
| pH | 9.5 | 9.5 | 8.2 | 8.4 | 8.5 |
| Temperature, °C. | 92 | 92 | 80 | 75 | 92 |
| Deposition rate, μm/hr | 6.8 | 15 | — | 2[a] | 1.8 |

[a]Based on 10-min deposition on palladium-activiated Mylar.

EXAMPLE 1

To demonstrate the relative solubility of yttrium and lanthanide series phosphites and hypophosphites in electroless nickel solutions yttrium and lanthanide series salts are added to a series of 10 ml standard electroless nickel solutions until a precipitate appears, indicating the solution is saturated with the respective yttrium or lanthanide series ion. The saturated solutions are filtered using a 0.5 micron filter. Then to each of the clear solutions is added 1 ml of 50% orthophosphoric acid. The solutions are then observed for precipitate. Yttrium, lanthanum, cerium, praseodymium, neodymium, samarium, europium, gadolinium, terbium, dysprosium, holmium, erbium, and thulium all precipitate with the addition of orthophosphite to the electroless nickel solution containing hypophosphite, indicating that the hypophosphite salt is more soluble than the orthophosphite.

EXAMPLE 2

To demonstrate the usefulness of this invention, which allows the selective precipitation of di-hydrogen phosphorous acid with lanthanide ions, particularly yttrium, the rate of electroless nickel deposition is determined in solutions without di-hydrogen phosphorous acid, with dihydrogen phosphorous acid concentrations equivalent to ten nickel regenerations, and after treatment with $Y_2(CO_3)_3.3H_2O$:

| Description: | $[Ni^{+2}]$ g/l | $[H_2PO_2-]$ g/l | $[H_3PO_3-]$ g/l | pH | Temp °C. | Rate mil/hr |
|---|---|---|---|---|---|---|
| Fresh solution | 6 | 30 | 0 | 4.8 | 90 | 1.1 |
| Ten Regeneration solution pH adjusted | 6 | 30 | 166 | 4.8 | 90 | 0.4 |
| Above after treatment with $Y_2(CO_3)_3-H_2O$ | 6 | 30 | 40 | 4.8 | 90 | 1.2 |

As can be seen from the above, treatment of a spent plating solution increases the rate of deposition and decreases the concentration of phosphite ions.

EXAMPLE 3

To further demonstrate the utility of this invention a plating test is performed in which the dihydrogen phosphorous acid concentration is generated by actual plating. The number of regenerations is calculated based upon the summation of nickel ion additions. When it is determined that ten regenerations of nickel ion have been added to the working solution the solution was treated with $Y_2(CO_3)_3.3H_2O$ by passing the solution through a filter containing excess $Y_2(CO_3)_3.3H_2O$:

| | Before Treatment | After Treatment |
|---|---|---|
| $[Ni^{+2}]$ | 6.0 | 6.0 |
| $[H_2PO_2-]$ | 50 | 40 |
| $[H_3PO_3-]$ | 141 | 93 |
| pH | 4.8 | 5.1 |

Following treatment, including additional filtration of the very fine $Y(H_2PO_3)_3$ precipitate, plating continues with no difference in quality from the untreated solution.

EXAMPLE 4

Two fresh electroless nickel solutions are analyzed (A1 and A2). Then the solutions are reanalyzed after the addition of hypophosphoric acid (B). These later solutions are then treated by the addition of a filtered and dried yttrium hypophosphite salt which has had been prepared by reacting a slurry of Y2 (CO3)3.3H2O with excess aqueous H2PO2. Following the addition of the salt, the mixtures are stirred for two hours. The mixtures are then filtered and analyzed (C). The results are:

| | A1 | A2 | B1 | B2 | C1 | C2 |
|---|---|---|---|---|---|---|
| Ni + 2 g/l | 7.5 | 7.6 | 7.1 | 6.9 | 5.1 | 5.3 |
| HPO3 – g/l | 0.6 | 0.4 | 149.4 | 146.3 | 78.8 | 79 |
| HPO2 – g/l | 29.1 | 29.4 | 28.6 | 28.4 | 50.8 | 50.4 |

The above data shows that yttrium hypophosphite is capable of exchanging with orthophosphite to produce a yttrium orthophosphite solid capable of being removed by filtration and consequently lowering the orthophosphite concentration.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of controlling orthophosphite ion in a hypophosphite-based electroless metal plating bath, comprising the steps of:

(1) contacting the plating bath with a yttrium metal salt or a lanthanide series metal salt to form an insoluble orthophosphite product, and (2) removing the insoluble orthophosphiate product from the bath.

2. The method of claim 1, wherein the metal of the metal salt is selected from the group consisting of yttrium, lanthanum, cerium, praseodymium, neodymium, samarium, europium, terbium, dysprosium, holmium, erbium, thulium and mixtures thereof.

3. The method of claim 1, wherein the metal of the metal salt is yttrium or lanthanum.

4. The method of claim 1, wherein the electroless plating bath is selected from a nickel, copper or cobalt electroless plating baths.

5. The method of claim 1, wherein the electroless plating bath is an electroless nickel plating bath.

6. The method of claim 1, wherein the contacting of step (1) occurs in a filter.

7. The method of claim 1, wherein the yttrium orlanthanide series metal salt is soluble in the plating bath.

8. The method of claim 1, wherein the metal salt is a yttrium carbonate or hypophosphite.

9. A method of regenerating a hypophosphite-based electroless metal plating bath by removing orthophosphite ions, comprising the steps of:

(A) contacting the plating bath with a yttrium or lanthanum series metal salt to form an insoluble yttrium or lanthanide series metal orthophospite, and (B) removing the insoluble yttrium or lanthanide series metal orthophosphite from the plating bath.

10. The method of claim 9, wherein the plating bath is a nickel plating bath.

11. The method of claim 9, wherein the yttrium or lanthanide series metal salt is added in an amount sufficient to remove at least about half of the phosphite ions in the bath.

12. The method of claim 9, wherein the metal of the metal salt is yttrium or lanthanum.

13. The method of claim 9, wherein the metal salt is a yttrium carbonate or hypophosphite.

14. The method of claim 9, wherein step (B) further comprises adding hypophosphite to the bath.

15. A continuous process of electroless metal plating, comprising the steps of:

(A) contacting a metal surface with a hypophosphite based electroless metal plating bath, (B) controlling the concentration of orthophosphite ion by contacting the bath with a yttrium metal salt or lanthanide series metal salt to form an insoluble yttrium or lanthanide series metal orthophosphite product, and (C) removing insoluble yttrium or lanthanide series metal orthophosphite from the bath.

16. The process of claim 15, wherein the bath is an electroless nickel plating bath.

17. The process of claim 15, wherein the metal of the metal salt is yttrium or lanthanum.

18. The process of claim 15, wherein the contacting of step (B) occurs in a filter.

19. The process of claim 15, further comprising:

(C) replenishing the electroless plating bath.

* * * * *

UNITED STATES PATENT AND TRADEMARK OFFICE

CERTIFICATE OF CORRECTION

PATENT NO. : 5,221,328

DATED : June 22, 1993

INVENTOR(S) : Craig V. Bishop, Gary W. Loar and Marlinda J. Thomay

It is certified that error appears in the above-identified patent and that said Letters Patent is hereby corrected as shown below:

Column 7, line 37, delete "orthophosphiate", add —orthophosphite—.

Column 8, line 5, delete "orlan-" add — or lan- —.

Signed and Sealed this

Eighteenth Day of January, 1994

Bruce Lehman

*Attest:*

BRUCE LEHMAN

*Attesting Officer*

*Commissioner of Patents and Trademarks*